US005493797A

United States Patent [19]

Jackson

[11] Patent Number: 5,493,797

[45] Date of Patent: Feb. 27, 1996

[54] WHEELED PLOW SHOVEL

[76] Inventor: Robert L. Jackson, 9 Maple Ave., Orangeburg, N.Y. 10962

[21] Appl. No.: 264,900

[22] Filed: Jun. 24, 1994

[51] Int. Cl.[6] ..... E01H 5/02

[52] U.S. Cl. ..... 37/285; 37/284

[58] Field of Search ..... 37/230, 231, 263, 37/264, 265, 280, 281, 282, 283, 284, 285; 172/180, 196, 700

[56] References Cited

U.S. PATENT DOCUMENTS

| | | | |
|---|---|---|---|
| 1,683,732 | 9/1928 | Selin | 37/265 X |
| 2,441,449 | 5/1948 | Shaw | 37/285 X |
| 4,275,514 | 6/1981 | Maura | 37/281 |
| 4,910,893 | 3/1990 | Asay | 37/284 X |
| 4,991,324 | 2/1991 | Fine et al. | 37/284 |
| 5,228,734 | 7/1993 | Pollastro | 37/285 X |

FOREIGN PATENT DOCUMENTS

| | | | |
|---|---|---|---|
| 2692296 | 6/1992 | France | 37/284 |

*Primary Examiner*—Randolph A. Reese
*Assistant Examiner*—Robert Pezzuto

[57] ABSTRACT

A wheeled plow shovel for plowing leaves or snow in a desired direction. The inventive device includes a main panel having a pair of wheels and a scraper blade extending downwardly therefrom. A handle is mounted to the main panel to permit manual manipulation of the device over a ground surface during a plowing procedure. In addition, a pair of slidably mounted wings can be extended laterally of the main body to increase a transverse width of the plowed area.

4 Claims, 3 Drawing Sheets

WHEELED PLOW SHOVEL

BACKGROUND OF THE INVENTION

1. Field of the Invention

The present invention relates to implements and more particularly pertains to a wheeled plow shovel for plowing leaves or snow in a desired direction.

2. Description of the Prior Art

The use of shovel implements is known in the prior art. More specifically, shovels heretofore devised and utilized for the purpose of pushing yard debris or the like in a desired direction are known to consist basically of familiar, expected and obvious structural configurations, notwithstanding the myriad of designs encompassed by the crowded prior art which have been developed for the fulfillment of countless objectives and requirements.

For example, an apparatus for taking up and removing matter from a surface as disclosed in U.S. Pat. No. 4,214,385 which includes a scoop portion and a handle portion secured thereto with one or more wheels rotatably mounted on an axis secured to the apparatus. The wheels are positioned so as to maintain the scoop portion of the apparatus at a predetermined angle relative to the surface.

Another patent of interest is U.S. Pat. No. 4,865,373 which teaches a snow shovel having wheels both in front of and behind the blade so as to position the blade at an angle between 30 and 35 degrees relative to the horizontal. An angularly bent handle positions grips at about waist height to permit a person to roll the shovel on the surface being cleaned.

Other know prior art implements include U.S. Pat. No. 4,629,203 and U.S. Pat. No. 4,804,219.

While these devices fulfill their respective, particular objectives and requirements, the aforementioned patents do not disclose a wheeled plow shovel for plowing leaves or snow in a desired directions which includes a main panel having a pair of wheels and a scraper blade extending downwardly therefrom with a handle mounted to the main panel to permit manual manipulation of the main panel over a ground surface during a plowing procedure, and a pair of slidably mounted wings which may be extended laterally of the main body to increase a transverse width of the plowed area.

In these respects, the wheeled plow shovel according to the present invention substantially departs from the conventional concepts and designs of the prior art, and in so doing provides an apparatus primarily developed for the purpose of plowing leaves or snow in a desired direction over a ground surface.

SUMMARY OF THE INVENTION

In view of the foregoing disadvantages inherent in the known types of implements now present in the prior art, the present invention provides a new wheeled plow shovel construction wherein the same can be utilized for plowing leaves or snow in a desired direction over a ground surface. As such, the general purpose of the present invention, which will be described subsequently in greater detail, is to provide a new wheeled plow shovel apparatus and method which has many of the advantages of the implements mentioned heretofore and many novel features that result in a wheeled plow shovel which is not anticipated, rendered obvious, suggested, or even implied by any of the prior art implements, either alone or in any combination thereof.

To attain this, the present invention generally comprises a wheeled plow shovel for plowing leaves or snow in a desired direction. The inventive device includes a main panel having a pair of wheels and a scraper blade extending downwardly therefrom. A handle is mounted to the main panel to permit manual manipulation of the device over a ground surface during a plowing procedure. In addition, a pair of slidably mounted wings can be extended laterally of the main body to increase a transverse width of the plowed area.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wheeled plow shovel apparatus and method which has many of the advantages of the implements mentioned heretofore and many novel features that result in a wheeled plow shovel which is not anticipated, rendered obvious, suggested, or even implied by any of the prior art implements, either alone or in any combination thereof.

It is another object of the present invention to provide a new wheeled plow shovel which may be easily and efficiently manufactured and marketed.

It is a further object of the present invention to provide a new wheeled plow shovel which is of a durable and reliable construction.

An even further object of the present invention is to provide a new wheeled plow shovel which is susceptible of a low cost of manufacture with regard to both materials and labor, and which accordingly is then susceptible of low prices of sale to the consuming public, thereby making such wheeled plow shovels economically available to the buying public.

Still yet another object of the present invention is to provide a new wheeled plow shovel which provides in the apparatuses and methods of the prior art some of the advantages thereof, while simultaneously overcoming some of the disadvantages normally associated therewith.

Still another object of the present invention is to provide a new wheeled plow shovel for plowing leaves or snow in a desired direction over a ground surface.

Yet another object of the present invention is to provide a new wheeled plow shovel which includes a main panel having a pair of wheels and a scraper blade extending downwardly therefrom with a handle mounted to the main panel to permit manual manipulation of the main panel over a ground surface during a plowing procedure, and a pair of slidably mounted wings which may be extended laterally of the main body to increase a transverse width of the plowed area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
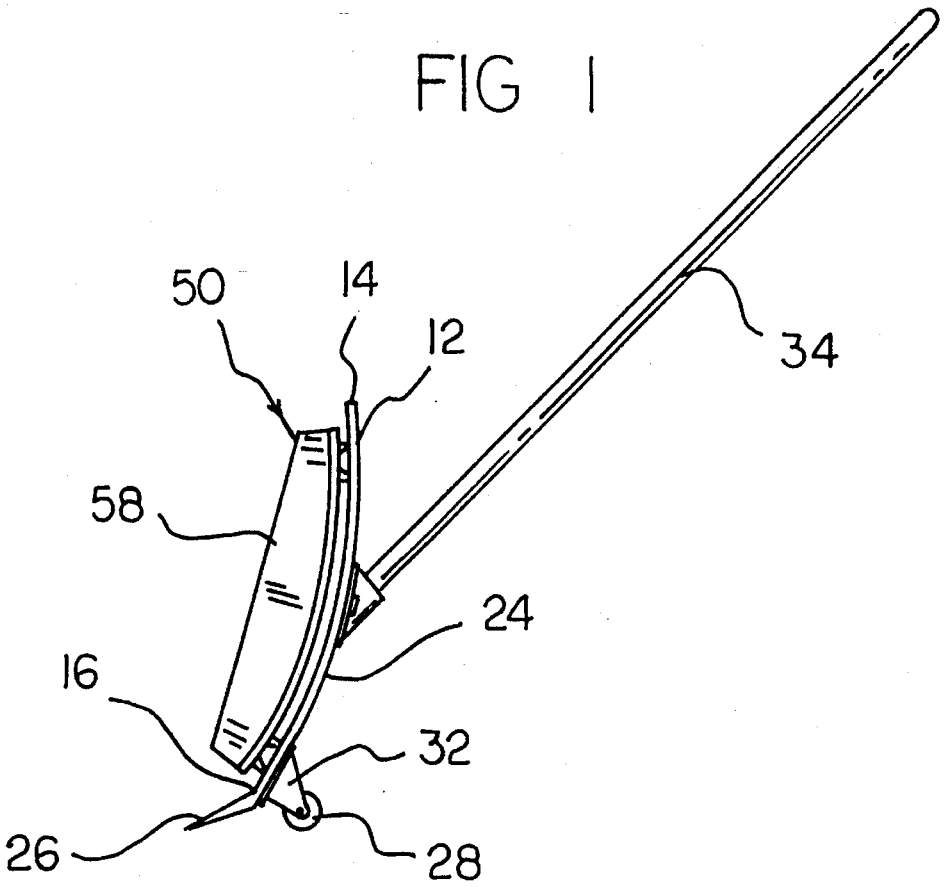
FIG. 1 is a side elevation view of a wheeled plow shovel comprising the present invention.

With reference now to the drawings, and in particular to FIGS. 1–6 thereof, a new wheeled plow shovel embodying the principles and concepts of the present invention and generally designated by the reference numeral 10 will be described.

Figure 2:
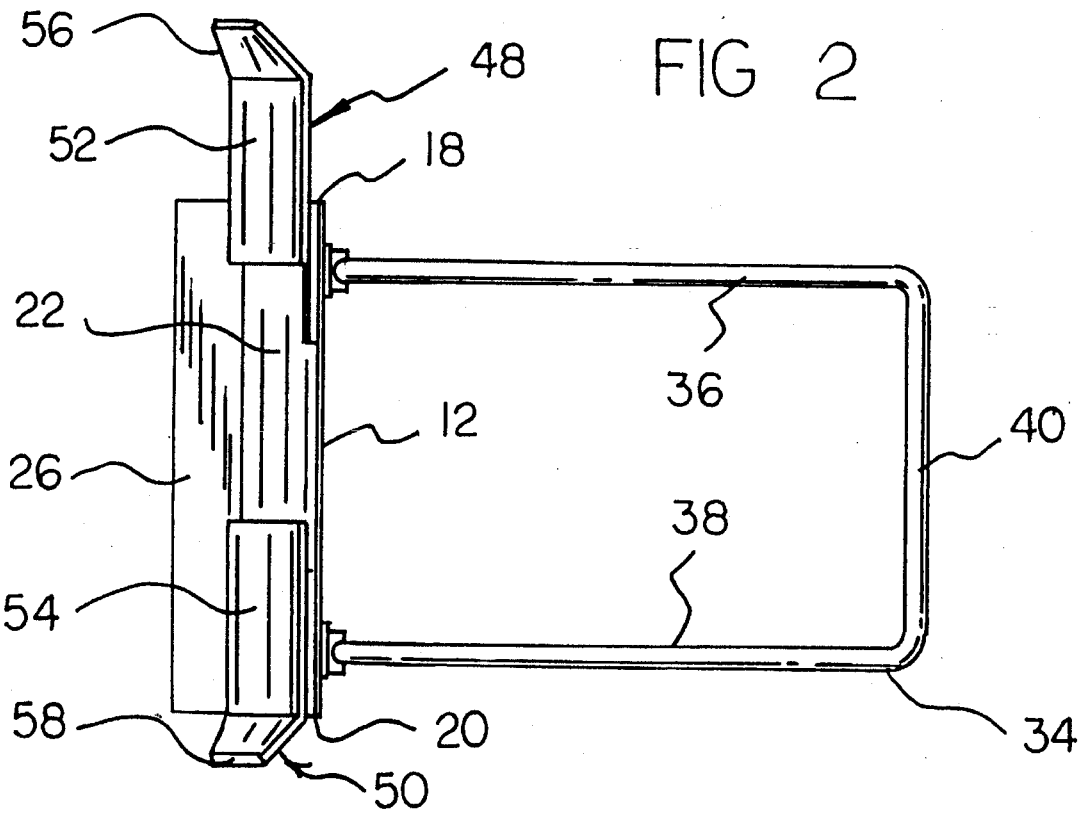
FIG. 2 is a top plan view of the present invention.

More specifically, it will be noted that the wheeled plow shovel 10 comprises a substantially arcuately shaped main panel 12 having a top edge 14, a bottom edge 16, and respectively opposed first and second lateral edges 18, 20, as best illustrated in FIGS. 1 and 2 of the drawings. The arcuate main panel 12 has a substantially curved shape defined by a first radius of curvature of predetermined length. Because of the arcuate or curved shape thereof, the main panel 12 can be further described as having a concave front face 22 and a convex rear face 24. As best illustrated in FIG. 1, a scraper blade 26 is integrally or otherwise fixedly secured to the bottom edge 16 of the main panel 12. The scraper blade 26 extends from the main panel 12 at an oblique angle relative to a tangent line taken along the convex rear face 24 at the bottom edge of the main panel. Further, the scraper blade 26 tapers as it extends from the bottom edge 16 of the main panel 12. The scraper blade 26 is operable to engage and closely scrape or clear a ground surface over which the shovel 10 is utilized.

Figure 4:
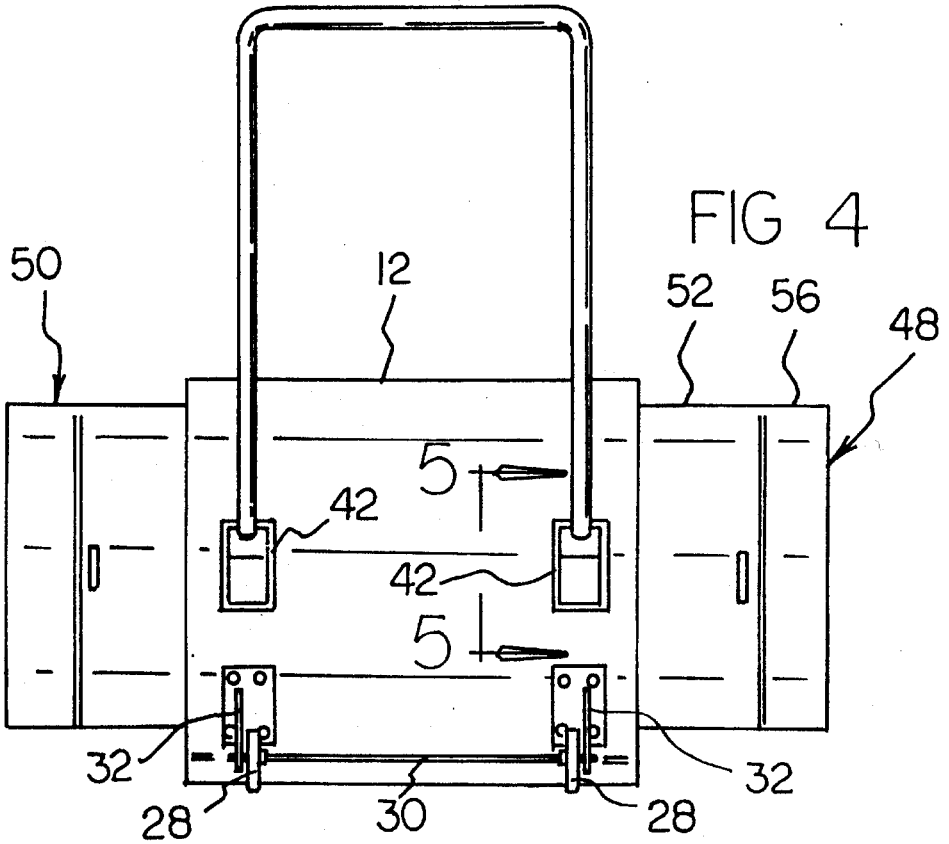
FIG. 4 is a rear elevation view thereof.

Referring now to FIG. 4, it can be shown that the main panel 12 is supported by a pair of wheels 28 rotatably mounted upon an axle 30 which extends between a pair of axle mounts 32. The axle mounts 32 are secured to the convex rear face 24 of the main panel 12 by a plurality of unlabeled conventional mechanical fasteners. The wheels 28 and their associated supporting structure 30, 32 permit the main panel 12 to be positioned in a desired orientation whereby the scraper blade 26 is positioned just above or in contact with a ground surface upon which the wheels 28 engage.

Figure 5:
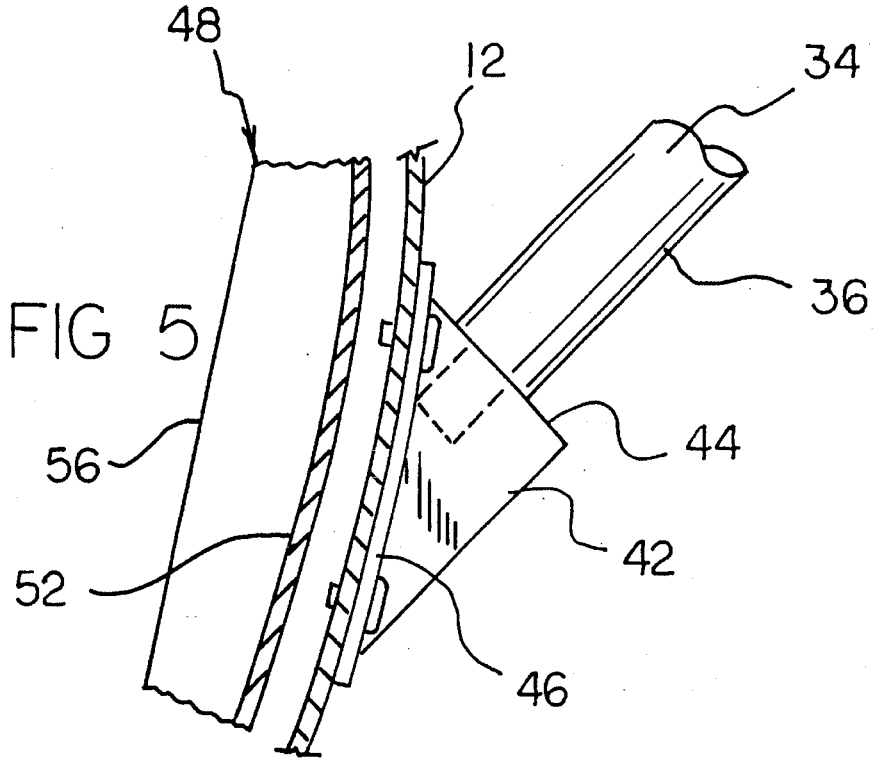
FIG. 5 is an enlarged cross-sectional view taken along line 5—5 of FIG. 4.

To facilitate manual manipulation of the device 10 over a ground surface, a handle 34 is mounted to the convex rear face 24 of the arcuate main panel 12 so as to extend upwardly therefrom, as illustrated in FIG. 1. The handle 34, as indicated in FIG. 2, comprises a first leg 36 spaced from and parallel to a second leg 38 with a cross bar 40 extending therebetween to define the substantially U-shaped handle. The legs 36, 38 of the handle 34 are coupled to the convex rear face 24 of the main panel 12 by a pair of handle mounts 42, as illustrated in FIGS. 4 and 5. Each of the handle mounts 42, as most clearly illustrated in FIG. 5, comprises a handle leg receiver 44 having a pair of laterally extending arcuate flanges 46, with each of the arcuate flanges having a radius of curvature substantially equal to the first radius of curvature of the arcuate main panel 12 so as to accurately follow a contour of the convex rear face 24. The handle mounts 42 are secured to the main panel 12 by conventional unlabeled mechanical fasteners, such as threaded fasteners, rivets, or the like. As such, the handle leg receiver 44 threadably receives a portion of the associated leg 36, 38 prior to mounting of the handle mount 42 to the main panel 12. Thus, because the legs 36, 38 of the handle 34 are precluded from future rotation by the cross bar 40, such threaded interconnection between the legs and the handle mounts 42 is precluded from unintentional loosening thereof.

Figure 3:
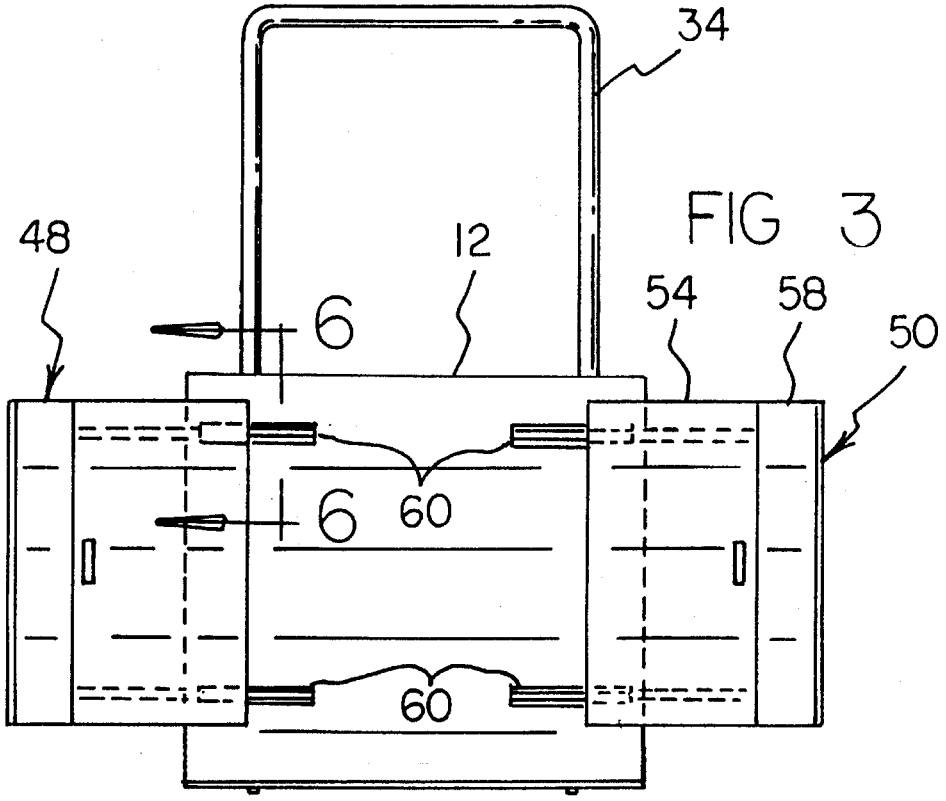
FIG. 3 is a front elevation view of the present invention.
Figure 6:
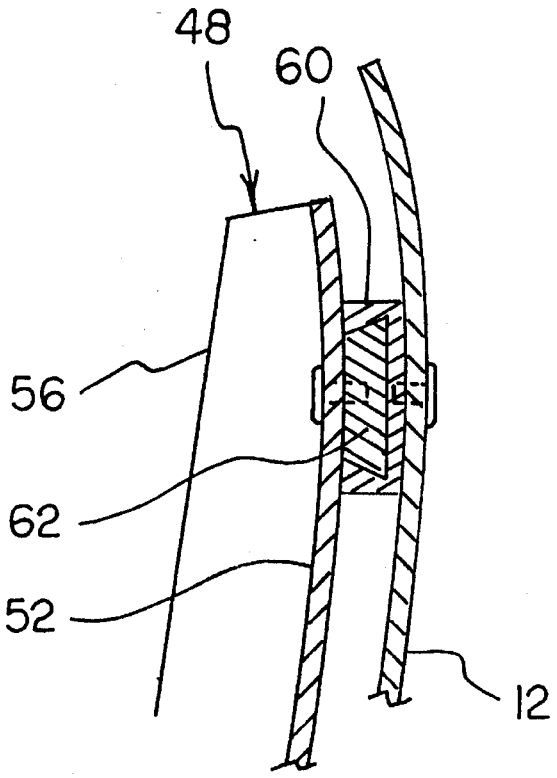
FIG. 6 is a further cross-sectional view taken along line 6—6 of FIG. 3.

To increase an effective plowing area of the main panel 12, a pair of wings 48, 50 is slidably mounted to the concave front face 22 of the main panel 12. The wings comprise a first wing 48 and a second wing 50 which are of substantially similar construction. To this end, the first wing 48 comprises a first inner wing panel 52 having a substantially arcuate shape defined by a second radius of curvature of a distance substantially less than the first radius of curvature of the arcuate main panel 12 such that the first inner wing panel can be positioned in the substantially parallel orientation relative to the main panel, as illustrated in FIG. 1. Similarly, the second wing 50 comprises a second inner wing panel 54 having the second radius of curvature. Extending from an outboard lateral edge of the first inner wing panel 52 is a first outer wing panel 56 which projects both outwardly and forwardly of the first inner wing panel at an oblique angle relative thereto, as illustrated in FIG. 2 for example. Similarly, a second outer wing panel 58 projects from the second inner wing panel 54 of the second wing 50. To slidably mount the first and second wings 48, 50 to the concave front face 22 of the main panel 12, a plurality of dove tail blocks 60 are provided. As illustrated in FIGS. 3 and 6, the dove tail blocks 60 are horizontally mounted in spaced pairs proximal to the opposed first and second lateral edges 18, 20 of the arcuate main panel 12. The dove tail blocks 60 each include an unlabeled elongated channel extending therethrough which slidably receives a dove tail 62 secured to each of the wings 48, 50 in a corresponding position relative to the mounting of the dove tail blocks. Thus, the wings 48, 50 are permitted to slidably extend relative to the main panel 12 past the lateral edges 18, 20 so as to increase a transverse width of the area being plowed. Although not specifically illustrated, it is desirable to include a locking means for securing the wings 48, 50 in a desired position relative to the main panel 12.

As best shown in FIG. 3, the scraper blade 26 projects below the bottom edge 16 of the main panel 12 to define an unlabeled first volume of space below the lower edge of the first inner wing panel 52 and along a first lateral side of the scraper blade. Further, the scraper blade 26 cooperates with main panel 12 to similarly define an unlabeled second volume of space below the lower edge of the second inner wing panel 54 and along a second lateral side of the scraper blade.

In use, the wheel plow shovel 10 may be utilized to plow leaves, snow, or other similar yard debris in a desired direction. If desired, the wings 48, 50 may be left in a stowed position, whereby the outer wing panels 56, 58 cooperate to preclude the plowed material from passing around the main panel 12. Alternatively, the wings 48, 50 may be extended laterally relative to the main panel 12 to increase the transverse width of the plowed area so as to push or plow more material in the desired direction. The handle 34, because of its double leg 36, 38 construction, precludes unintentional rotating of the main panel 12 about a vertical axis should the amount of material engaged against either of the wings 48, 50 exceed that of the material engaged against the other wing. As such, the construction of the handle 34 permits a single one of the wings 48, 50 to be engaged to the plowed material while the other wing remains stowed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wheeled plow shovel comprising:

a main panel having a top edge, a bottom edge, respectively opposed first and second lateral edges, and front and rear faces;

wheel means for movably supporting said main panel relative to a ground surface;

a handle mounted to said rear face of said main panel for facilitating manual manipulation of said shovel wherein said handle is substantially U-shaped and comprises a first leg spaced from and parallel to a second leg with a cross bar extending between said legs to define said substantially U-shaped handle, and further wherein said legs of said handle are coupled to said rear face of said main panel by a pair of handle mounts, each of said handle mounts including a handle leg receiver having a pair of laterally extending flanges, with each of said flanges being secured to said main panel, with each handle leg receiver threadably receiving a portion of an individual one of said legs prior to a mounting of said handle mount to said main panel;

a scraper blade fixedly secured to said bottom edge of said main panel, said scraper blade extending from said main panel at an oblique angle relative to said main panel;

a first wing movably mounted to said main panel and adjustably positionable laterally of said main panel, said first wing having a rear face, with at least a portion of said rear face of said first wing being positioned in a facing orientation with said front face of said main panel, with said first wing comprising a first inner wing panel with a first outer wing panel extending from an outboard lateral edge of said first inner wing panel, said first outer wing panel projecting both outwardly and forwardly of said first inner wing panel at an oblique angle relative thereto, with said first wing being movable relative to said main panel such that said outboard edge of said first inner wing panel is selectively positionable into alignment with said first lateral edge of said main panel, said first inner wing panel of said first wing including a lower edge positioned into alignment with said bottom edge of said main panel; and, a second wing movably mounted to said main panel and adjustably positionable laterally of said main panel, said second wing having a rear face, with at least a portion of said rear face of said second wing being positioned in a facing orientation with said front face of said main panel, with said second wing comprising a second inner wing panel with a second outer wing panel extending from an outboard lateral edge of said second inner wing panel, said second outer wing panel projecting both outwardly and forwardly of said second inner wing panel at an oblique angle relative thereto, with said second wing being movable relative to said main panel such that said outboard edge of said second inner wing panel is selectively positionable into alignment with said second lateral edge of said main panel, said second inner wing panel of said second wing including a lower edge positioned into alignment with said bottom edge of said main panel, with said scraper blade projecting below said bottom edge of said main panel to define a first volume of space below the lower edge of the first inner wing panel and along a first lateral side of said scraper blade, and a second volume of space below the lower edge of the second inner wing panel and along a second lateral side of said scraper blade.

2. The wheeled plow shovel of claim 1, wherein said wings are mounted to said main panel by a plurality of dove tail blocks and a plurality of dove tails.

3. The wheeled plow shovel of claim 2, wherein said wheel means comprises a pair of wheels rotatably mounted upon an axle which extends between a pair of axle mounts, said axle mounts being secured to said rear face of said main panel.

4. A wheeled plow shovel comprising:

a substantially arcuately shaped main panel having a top edge, a bottom edge, respectively opposed first and second lateral edges, a concave front face, and a convex rear face, said arcuate main panel having a substantially curved shape defined by a first radius of curvature of predetermined length;

a scraper blade fixedly secured to said bottom edge of said main panel and extending therefrom at an oblique angle relative to a tangent line taken along said convex rear face at said bottom edge of said main panel, said scraper blade tapering as it extends from said bottom edge of said main panel;

a pair of wheels rotatably mounted upon an axle which extends between a pair of axle mounts, said axle mounts being secured to said convex rear face of said main panel;

a substantially U-shaped handle mounted to said convex rear face of said arcuate main panel so as to extend upwardly therefrom, said handle comprising a first leg spaced from and parallel to a second leg with a cross bar extending between said legs to define said substantially U-shaped handle, said legs of said handle being coupled to said convex rear face of said main panel by a pair of handle mounts, each of said handle mounts including a handle leg receiver having a pair of laterally extending arcuate flanges, with each of said arcuate flanges having a radius of curvature substantially equal to said first radius of curvature of said arcuate main panel, said flanges being coupled to said rear face of said main panel, with said-handle receiver threadably receives a portion of an individual one of said legs prior to mounting of said handle mount to said main panel such that said legs of said handle are precluded from future rotation by said cross bar so as to preclude unintentional loosening of said legs from said handle receivers;

a pair of wings slidably mounted to said concave front face of said main panel, each of said wings comprising an inner wing panel having a substantially arcuate shape defined by a second radius of curvature of a distance substantially less than said first radius of curvature of said arcuate main panel such that said inner wing panel can be positioned in a substantially parallel orientation relative to said main panel, and an outer wing panel extending from an outboard lateral edge of said inner wing panel and projecting both outwardly and forwardly of said inner wing panel at an oblique angle relative thereto, said wings each having a rear face, with at least a portion of said rear face of each of said wings being positioned in a facing orientation with said front face of said main panel, with said wings each comprising an inner wing panel with an outer wing panel extending from an outboard lateral edge of said inner wing panel, said outer wing panel projecting both outwardly and forwardly of said inner wing panel at an oblique angle relative thereto, with said wings each being movable relative to said main panel such that said outboard edge of said inner wing panel is selectively positionable into alignment with a respective one of said lateral edges of said main panel, said inner wing panels of said wings each including a lower edge positioned into alignment with said bottom edge of said main panel, said scraper blade projecting below said bottom edge of said main panel to define a first volume of space below the lower edge of a first one of the inner wing panels and along a first lateral side of said scraper blade, and a second volume of space below the lower edge of a second one of the inner wing panels and along a second lateral side of said scraper blade;

a plurality of dove tail blocks, with each of said dove tail blocks being horizontally mounted in spaced pairs proximal to said opposed first and second lateral edges of said arcuate main panel, said dove tail blocks each including an elongated channel extending therethrough;

a plurality of dove tails, each of said dove tails being slidably positioned within said channel of an individual one of said dove tail blocks and secured to an individual one of said wings, whereby said wings are permitted to slidably extend relative to said main panel past said lateral edges so as to increase a transverse width of an area being plowed.

* * * * *